US006467318B1

(12) United States Patent
Gattiker

(10) Patent No.: US 6,467,318 B1
(45) Date of Patent: Oct. 22, 2002

(54) THEFT-RESISTANT RELEASABLE CONTAINER FOR VALUABLE ARTICLES

(75) Inventor: Anton Gattiker, Bonita, CA (US)

(73) Assignee: Wherehouse Entertainment, Inc., Torrance, CA (US)

( * ) Notice: Subject to any disclaimer, the term of this patent is extended or adjusted under 35 U.S.C. 154(b) by 0 days.

(21) Appl. No.: 09/561,010

(22) Filed: Apr. 28, 2000

(51) Int. Cl.[7] ..... E05B 73/00

(52) U.S. Cl. ..... 70/57.1; 70/58; 70/63; 206/1.5; 206/308.2; 206/387.11

(58) Field of Search ..... 70/57.1, 63, 58; 206/1.5, 308.2, 387.11

(56) References Cited

U.S. PATENT DOCUMENTS 5,802,890 A * 9/1998 Espada-Velasco ..... 70/57.1
5,850,752 A * 12/1998 Lax ..... 70/276
5,931,031 A * 8/1999 Bouan ..... 70/57.1
5,956,981 A * 9/1999 Weisburn et al. ..... 70/57.1
6,240,750 B1 * 6/2001 Gillespie et al. ..... 70/57.1

* cited by examiner

*Primary Examiner*—Lloyd A. Gall
(74) *Attorney, Agent, or Firm*—Christie, Parker & Hale, LLP

(57) ABSTRACT

A theft-resistant container or keeper of the instant invention is suitable for use with a case having a hinged edge and an opening edge, the keeper comprising a frame, a locking mechanism, a cover member. The frame has a back panel, a top wall, a bottom wall, a side wall and an extended frame portion off the bottom wall, the side wall substantially covering the opening edge of the case when contained in the keeper. The locking mechanism is substantially housed in the extended frame portion, the locking mechanism having a locking tab, a locking member and a latch. The locking mechanism is movable between a locked position and a unlocked position where the locking tab is biased toward the locked position. Spring members may also be provided in the frame to adapt the frame to cases of varying sizes and dimensions. A releasor is provided to release the case from the theft-resistant container.

21 Claims, 7 Drawing Sheets

THEFT-RESISTANT RELEASABLE CONTAINER FOR VALUABLE ARTICLES

FIELD OF THE INVENTION

This invention relates to an improved theft-resistant container for holding valuable articles such as cases containing compact discs or digital video discs, which may be released therefrom with the use of a releasor.

BACKGROUND OF THE INVENTION

With the present growth and expansion in computer and other electronic communication technology, compact discs (CDs), digital video discs (DVDs) and any other compact data storage media (herein collectively referred to as "CD/DVDs") are more popular than ever. They indeed present a very convenient and economic means by which a vast amount of data may be stored and carried. However, attendant with such growing popularity, the theft of CD/DVDs from retail stores is on the rise, as well as the aggressiveness and ingenuity by which thefts of this nature are accomplished.

Since CDs and DVDs are typically stored in individual cases, some being known as "jewel boxes," the related industries and particularly retail stores have sought to curb the theft of CD/DVDs by securing such cases in anti-theft holders or security packages that hold the CD/DVDs and the cases while they are on display for consumer purchase. Some of these devices are destroyed or substantially mutilated when the CD/DVD case is legitimately released during purchase; other devices use keys or unlocking devices so that the anti-theft holders may be preserved and reused. Some of these anti-theft (or allegedly anti-theft) holders and packages are disclosed in various U.S. Patents including U.S. Pat. Nos. 4,567,983; 4,805,769; 4,834,238; 5,289,914; 5,460,266; 5,560,381; 5,601,188 and 5,762,187, to name a few. A particular prior device of interest is disclosed in European Patent Application No. 93104568.6, published under Publication No. EP 0 562 491 A1. Another prior device of interest is by Alpha Enterprises, Inc. (North Canton, Ohio), marketed under the name Trimline Act 200.

Although the devices of these aforementioned prior patents and other similar devices have reduced the theft of CDs/DVDs, such security holders are nevertheless often found discarded still within the store premises, having been tampered or otherwise compromised with respect to the valuable article they previously contained, namely, the CD or DVD. While the case or jewel box may still be contained within the security holder, the CD or DVD itself has been removed through different means typically involving forced entry into the jewel box and/or the security holder. The frame of the security holder often is deformed, permanently or temporarily, by the application of heat such as from a cigarette lighter. In some cases, heat is not needed or used, for the underlying construction material of the frame is simply too pliable to resist the average person's manual manipulation. Of these prior devices that provided an electronic sensor tag, such tags would often escape detection when they were deformed or otherwise subjected to a compressive force which adversely affected their ability to be sensed by detectors. Unfortunately, store employees also play a role in the theft of CD/DVDs. Since store employees have access to the keys which release the security holder, they either participate directly in the theft or contribute indirectly when they lose or misplace the keys.

While it may have been possible to increase the strength and integrity of the frame of the security holder by simply increasing the thickness and/or size of the frame construction, it is a delicate line between the benefit of such added strengthening measures and the desire to streamline the profile of security cases and holders. In the latter regard, it is aesthetically desirable to maximize visibility of the underlying secured jewel box, while minimizing the visibility of the security features of the frame. It is also functionally desirable to minimize the size of the frame so that the quantity of jewel boxes or cases displayed or stored may be maximized.

Although the device of the aforementioned European Patent Application No. 93104568.6 and the Trimline Act 200 sought to and may have solved some of the shortcomings of the earlier devices by providing (i) a frame configuration with extensive visibility of the underlying jewel box or cases, (ii) a tamper-resistant locking means and unlocking means, and (iii) a tamper-resistant locale for housing an electronic sensor or detection tag, this security device is still wanting in many respects. In particular, due to the different sizes of cases, particularly DVD cases, by different manufacturers, the disparity in size between the underlying case and the security holder allows sufficient room for the DVD case to be manipulated out of the security case even where its structural strength has been increased. Moreover, the orientation of the case within the security device should be such that opening of the case is rendered nearly impossible, or very difficult. Also, there is a growing desire for such security holders to provide ease and convenience when inserting and removing the secured article. Particularly, where each CD/DVD jewel box or case has to be removed from its security holder at purchase, there is a strong desire for a security holder which facilitates the removal of the jewel box or case from the security holder.

Accordingly, there exists a demand for an improved theft-resistant security holder for valuable articles, which is more resistive to theft, better adapted to cases of different sizes, and more facilitative of the unlocking and legitimate removal of the secured CD/DVDs.

SUMMARY OF THE INVENTION

In accordance with the present invention, a theft-resistant container suitable for securing a valuable article is provided, having a frame, a locking mechanism with a locking tab, a locking member and a bias member, the locking tab being movable between a locking position and an unlocking position and the bias member biasing the locking tab toward the unlocking position.

An embodiment of the theft-resistant container or keeper of the instant invention is suitable for use with a case having a hinged edge (actual or "living") and an opening edge, the keeper comprising a frame, a locking mechanism and a cover member. The frame has a back panel, a top wall, a bottom wall and a side wall that desirably covers the opening edge of the case when contained in the keeper. The locking mechanism has a locking tab, a locking member and a bias member and is movable between a locked position and an unlocked position. The bias member desirably biases the locking tab toward the unlocked position to facilitate removal or insertion of the case. Advantageously, spring members may also be provided in the frame to adapt the frame to cases of varying sizes and dimensions.

In another embodiment, the present invention also includes an anti-theft system for use in securing a valuable article, comprising a keeper and a releaser. The keeper has at least a frame and a locking mechanism. The frame has a side wall substantially covering the opening edge of the valuable article when contained in the frame, and the locking mechanism has a bias member which biases a locking tab toward the unlocking position. The releasor is adapted to release the valuable article from the keeper.

These, as well as other features of the invention, will become apparent from the detailed description which follows, considered together with the appended drawings.

DESCRIPTIONS OF THE DRAWINGS

In the drawings, which constitute a part of this specification, exemplary embodiments demonstrating various features of the invention are set forth as follows.

DESCRIPTION OF THE ILLUSTRATIVE EMBODIMENTS

As indicated above, detailed illustrative embodiments are disclosed herein. However, structures for accomplishing the objectives of the present invention may be detailed quite differently from the disclosed embodiments. Consequently, specific structural and functional details disclosed herein are merely representative; yet, in that regard, they are deemed to afford the best embodiment for purposes of disclosure and to provide a basis for the claims herein which define the scope of the present invention.

Figure 1:
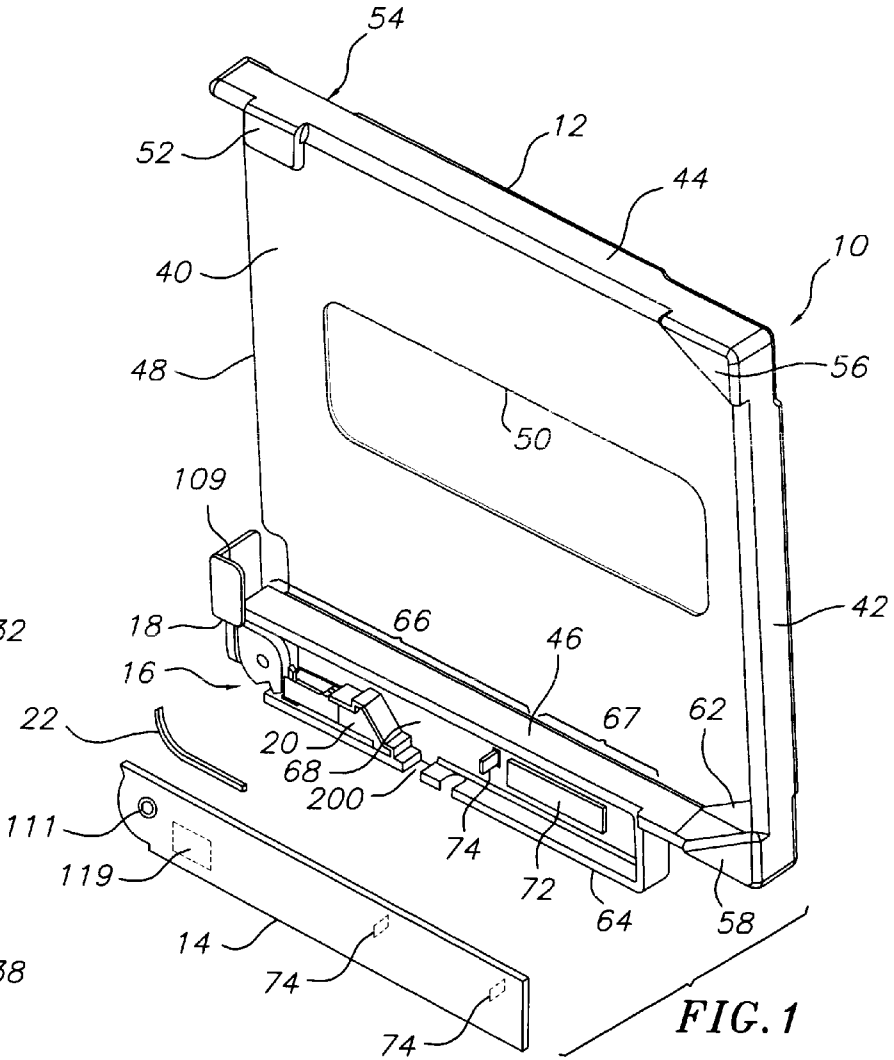
FIG. 1 is a perspective, partially-exploded view of an embodiment of a theft-resistant container of the instant invention, for securing a valuable article.

Referring to FIG. 1, a theft-resistant security keeper or holder 10 for CDs, DVDs and the like (hereinafter collectively "CD/DVDs") is illustrated. In the disclosed embodiment, the keeper comprises of a frame 12, a cover member 14, and a locking mechanism 16 situated substantially between the frame and cover member. The locking mechanism 16 includes a pivotable locking tab 18, a releasable locking member 20 and a bias member 22. Any or all of these members, except for perhaps the bias member 22, may be constructed by means of injection molding. The frame 12 may be constructed of a plastic material, for example, polycarbonate, which is desirably transparent and suitably strong and substantially nondeformable under normal operating and use conditions of the keeper 10. In contrast, the pivotable locking tab 18 and the releasable locking member 20 may be opaque, and constructed of a nylon material containing a certain percentage of glass fiber for relatively increased strength and rigidity. Such percentage may range between approximately 10% and 30%, and is preferred to be approximately 20%.

Figure 2:
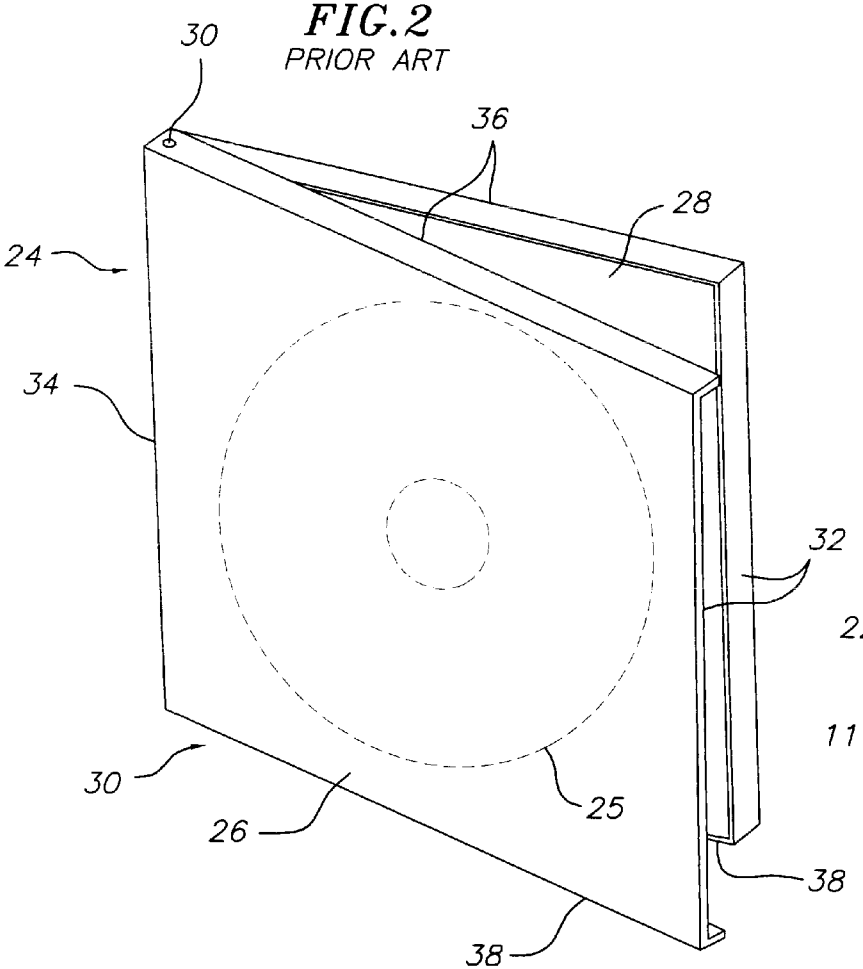
FIG. 2 PRIOR ART
FIG. 2 is a perspective view of a case containing a valuable article, namely a CD, of the prior art.

To better describe the security keeper, a description of a known jewel box 24 containing a CD 25 is described preliminarily. Referring to FIG. 2, the jewel box 24 comprises primarily of a front member 26 and a back member 28. These members are pivotally attached to each other at pivots 30 such that the jewel box 24 may be opened up much like a book. There is an edge 34 along which the members 26 and 28 are hinged, and when the jewel box 24 is closed, there is an opening edge 32 parallel to and opposing the edge 34. There are also an upper edge 36 and a lower edge 38 extending between the edges 32 and 34. The security keeper 10 is configured to be in relatively close conformity to the size and configuration of the jewel box 24.

When the jewel box 24 is inserted into and held within the security keeper 10, the frame 12 of the security keeper of FIG. 1 can be understood to extend along and substantially cover the back member 28 of the jewel box and its edges 32, 36 and 38, leaving only the hinged edge 34 of the jewel box substantially exposed. As such, the frame 10 is configured with a back panel 40 from which a side wall 42, a top wall 44 and a bottom wall 46 extend normally. Extending between the top wall 44 and the bottom wall 46 is an exposed edge 48 substantially parallel to the hinged edge 34 of the jewel box 24. It is along the edge 48 that the jewel box 24 may be most readily inserted into or removed from the keeper 10. The back panel 40 defines an enlarged opening 50 to reduce the material cost and weight of the security keeper, as well as facilitating the removal of the jewel box 24 from the keeper. The enlarged opening 50 also maximizes the visibility of the jewel box 24 when contained in the keeper 10.

The top wall 44 of the keeper 10 provides a flange or tab 52 extending normally therefrom, to substantially abut the front member 26 of the jewel box 24 when contained in the keeper 10. Due to production reasons, an aperture 54 (not shown) is configured on the back panel 40 facing the tab 52. Extending between the top wall 44 and the side wall 42 is a first corner tab 56. Extending between the bottom wall 46 and the side wall 42 is a second corner tab 58. Due to production reasons, apertures 60 (not shown) and 62 are defined on the back panel 40 facing the comer tabs 56 and 58, respectively. As explained below in further detail, the tabs 52, 56 and 58 work in conjunction with the locking tab 18 of the locking mechanism 16 to contain the jewel box 24 within the security holder 10 until the jewel box is legitimately released.

To accommodate the locking mechanism 16, the frame 10 provides an extended frame portion 64 off the bottom wall 46 which may be described in two sections 66 and 67. Section 66 houses the locking member 20 and a portion of the locking tab 18 within space 68 defined by the bottom wall 46, the extended frame portion 64 and the cover member 14. Section 67 is configured to provide a space 70 defined by the bottom wall 46, the extended frame portion 64 and the cover member 14, for containing an electronic sensor tag 72. The spaces 68 and 70 and may be separated and/or segregated by an internal wall (not shown), or simply divided by a rivet or other protruding structure such as a rib 74 extending between the extended frame portion 64 and the cover member 14. The dividing structure 74 serves to minimize movement of the sensor tag 72 within the space 70. Comparable ribs 74 may also be provided on the cover member 14 to facilitate alignment between the cover member 14 and the extended bottom portion 64 when the two are ultrasonically welded, as understood by one of ordinary skill in the art. The electronic sensor tag 72 may be any of a variety of electronic sensors now available in the marketplace, as understood by one of ordinary skill in the art. Suitable sensor tags are available from Sensormatic Electronics Corporation of Boca Raton, Fla., U.S.A. As described in further below, the extended frame portion 64 and the cover member 14 jointly enclose the electronic sensor tag 72 within the space 70 such that the tag 72 is protected from tampering, such as deformation or other compressive forces which may compromise its detection by sensors.

Figure 3:
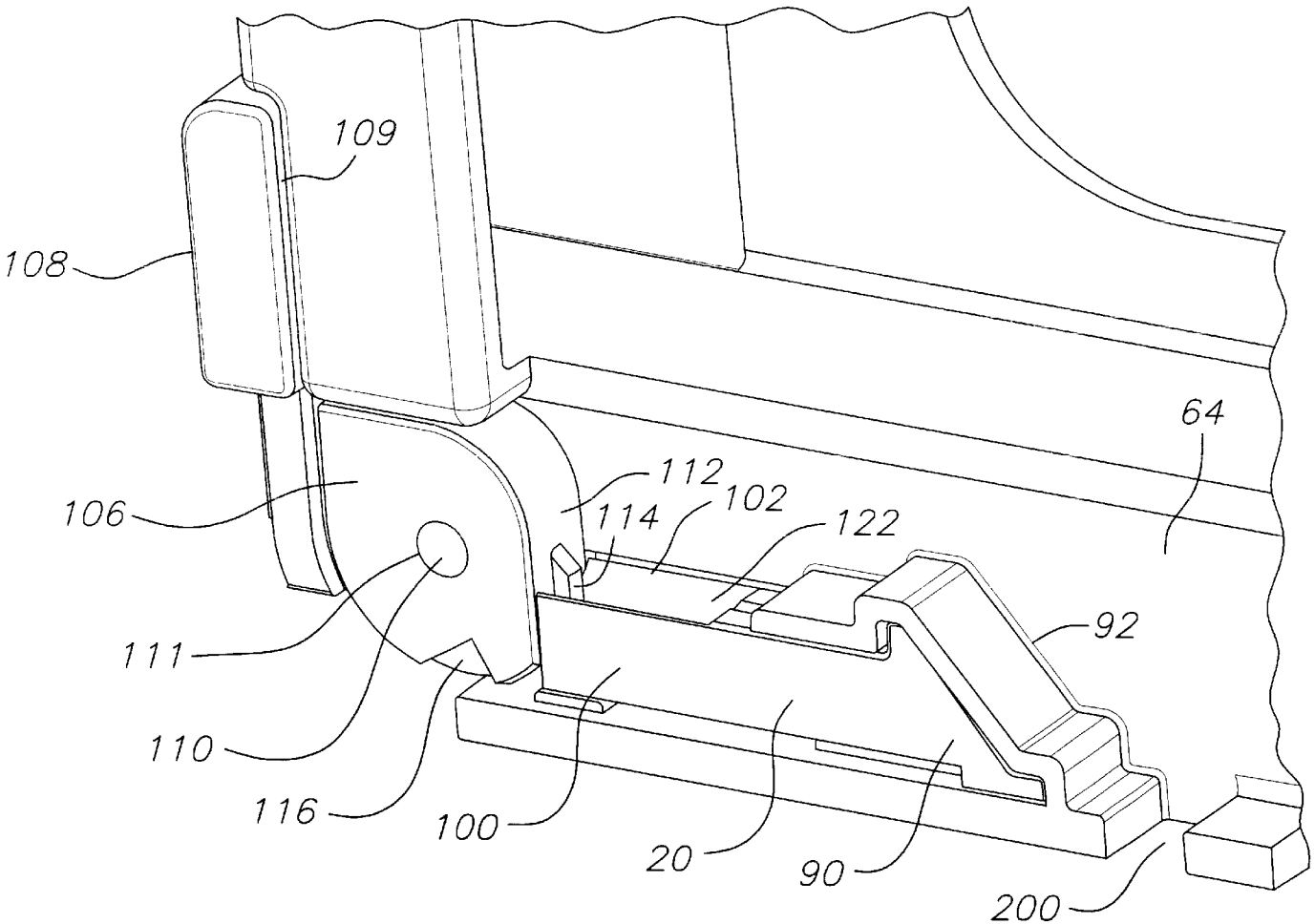
FIG. 3 is a perspective view of a portion of the theft-resistant container of FIG. 1, in the locked position.

The locking mechanism 16 which is housed substantially between the extended frame portion 64 and the cover member 14 is now described in detail. Referring to FIG. 3 (which shows the keeper 10 without the cover member 14 or the bias member 22), the locking mechanism 16 includes the bias member 22, the locking tab 18 (shown in the closed or locked position), and the locking member 20. The locking member 20 may be injection-molded as a single, integral piece. It has one end 90 which is adapted for affixation to the extended frame portion 64. In one embodiment, the end 90 is configured to be received by a fastening member or clip 92 that is formed from the extended frame portion 64 and may be constructed as an integral portion of the extended frame portion 64. Once received, the end 90 secures the locking member 20 to the clip 92 and therefore to the frame 10 (FIG. 1), such that there is minimal relative movement therebetween. An opposing end of the locking member 20 is configured with two prongs 100 and 102 which extend parallel with the bottom wall 64 of the frame 10. The prongs have ends which maintain or otherwise lock the locking tab 18 in the closed position, as described in detail further below.

Figure 4:
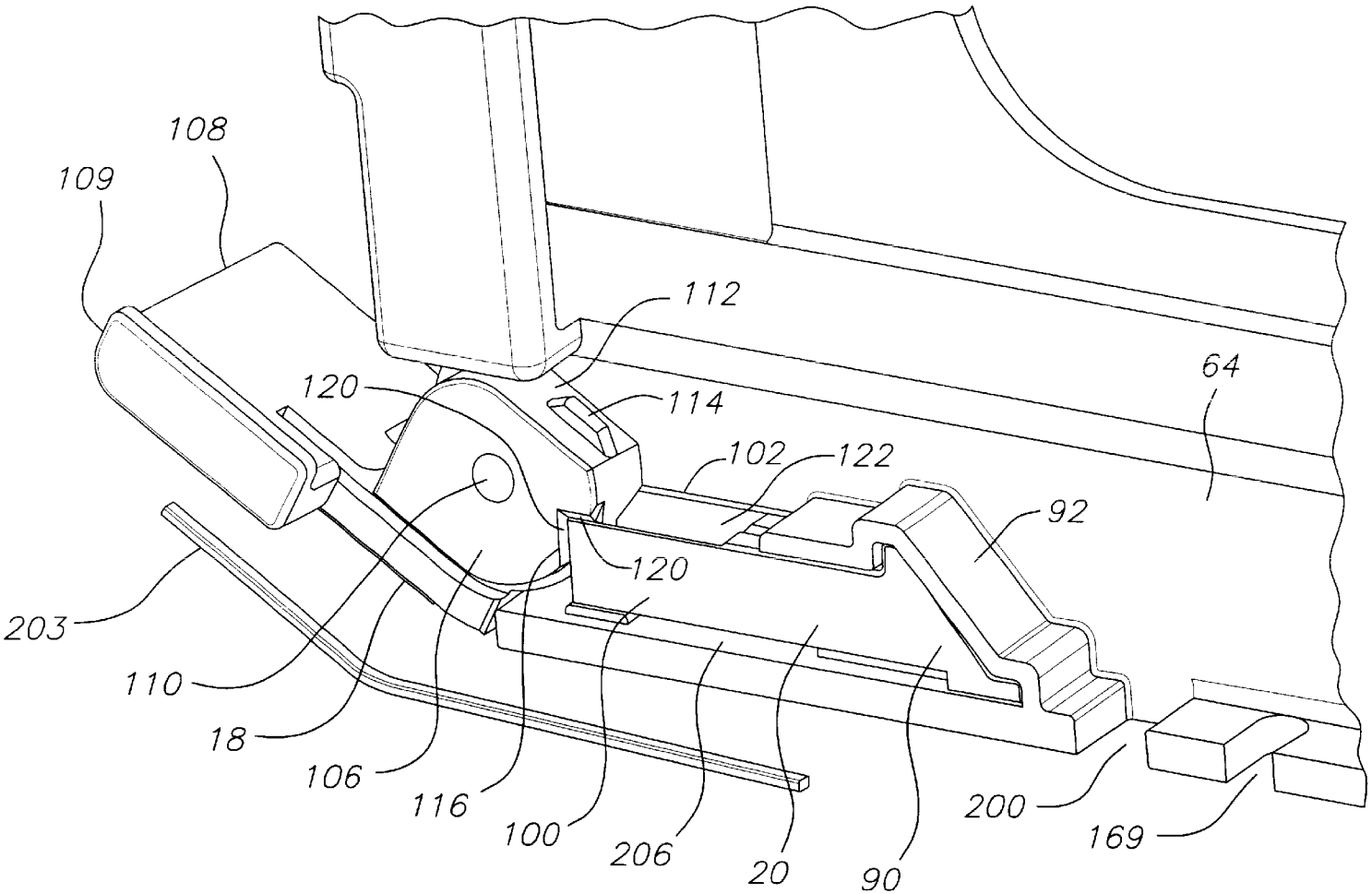
FIG. 4 is a perspective view of a portion of the theft-resistant container of FIG. 1, in the unlocked position.

The locking tab 18 includes a somewhat annular body portion 106 and an article-securing portion 108 having an L-shaped cross-section with lip 109, the entirety of which may be injection molded as a single integral piece. The body portion 106 defines an aperture 111 through which a rivet 110 or other securing means which allows the entirety of the locking tab 18 to be secured to the extended frame portion 64 while being pivotal about an axis defined by the rivet 110 between the closed or locked position of FIG. 3, and an open or unlocked position (FIG. 4). As better illustrated in FIG. 3, when the locking tab is in the closed or locked position, the locking tab 18 is prevented from pivoting out of this position by the prongs 100 and 102 of the locking member, as the prongs abut and remain in contact with a flat region 112 of the body portion 106. The flat region 112 is configured with a ridge 114 so as to maintain separation between the prongs 100 and 102. Moreover, due to a predetermined level of rigidity of the prongs 100 and 102, they cannot be readily separated by forcibly pivoting the locking tab 18. As such, the locking tab 18 once in the closed or locked position effectively remains closed or locked until the security keeper 10 is legitimately released by a releasor described further below.

It can best be seen in FIG. 4 (which shows the keeper 10 with the bias member 22, but still without the cover member 14), that the body portion 106 of the locking tab 18 is configured with two recesses 116 and 118 (not shown) for receiving the prongs 100 and 102, respectively, when the locking tab 18 is pivoted or rotated (counterclockwise) to the open or unlocked position. The recesses 116 and 118 are shaped so that the prong 100 and 102 are in their natural, unbent and/or unstressed position when received in the recesses of the locking tab. Both the recesses 116 and 118 and the prongs 100 and 102 are configured with inclined portions 120 and 122, respectively, so that the prongs are guided and readily separate from each other under pressure from the locking tab 18 as it is rotated from the unlocked position to the locked position. Recesses 117 (not shown) and 119 (FIG. 1 in broken lines) are provided in the extended frame portion 64 and the cover 14, respectively, to accommodate the prongs 102 and 100 whenever they separate.

Figure 6:
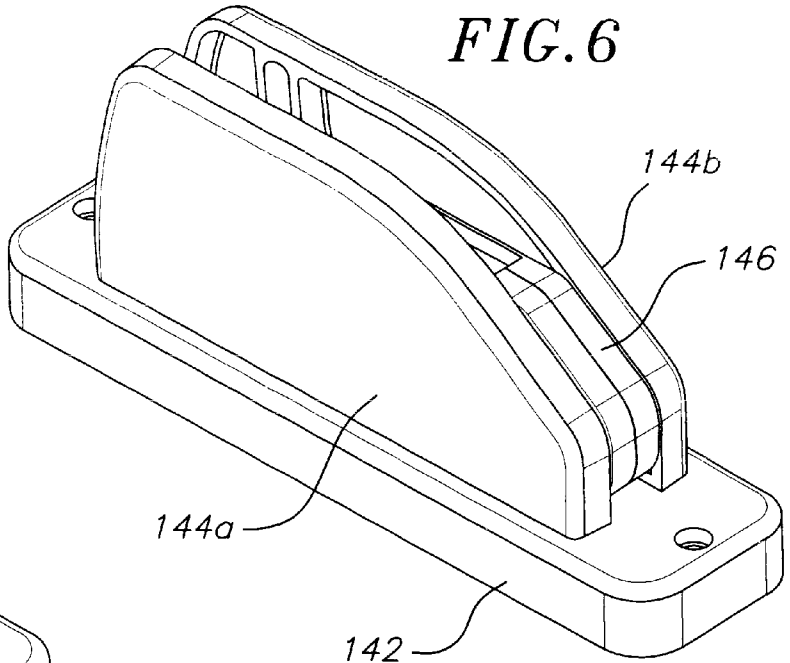
FIG. 6 is a perspective view of the release of FIG. 5, in the lowered position.
Figure 5:
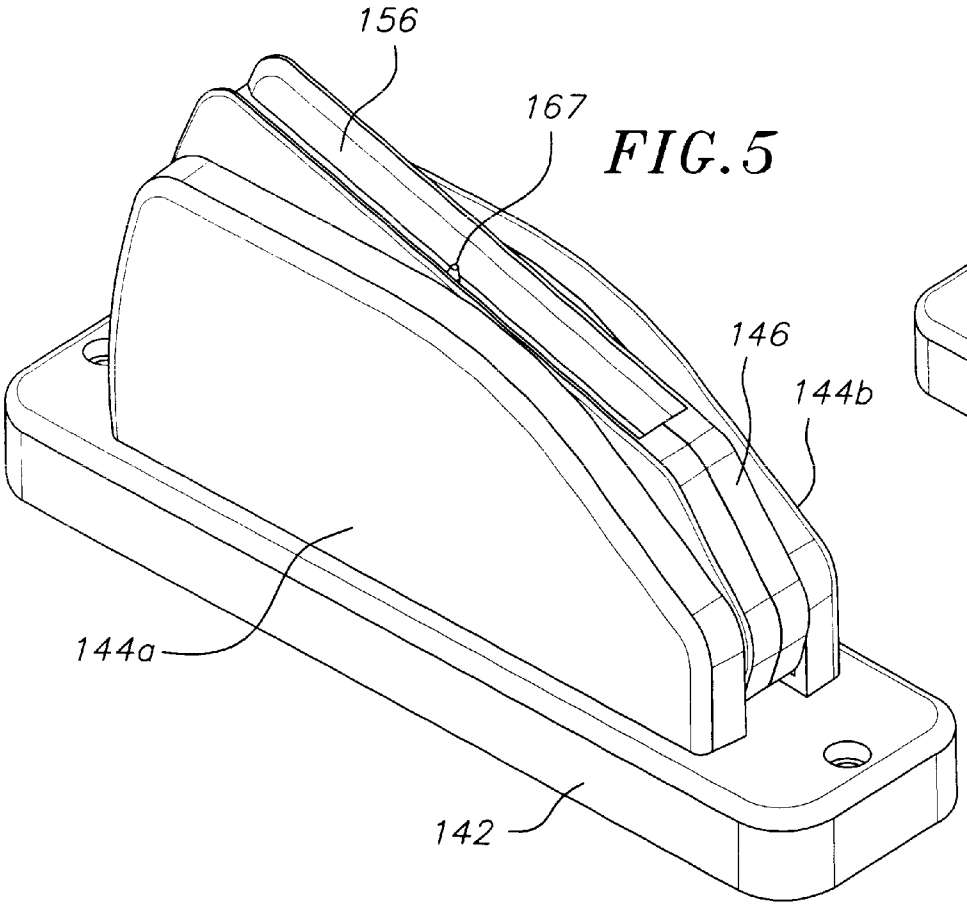
FIG. 5 is a perspective view of an embodiment of a releasor, in the raised position.
Figure 8:
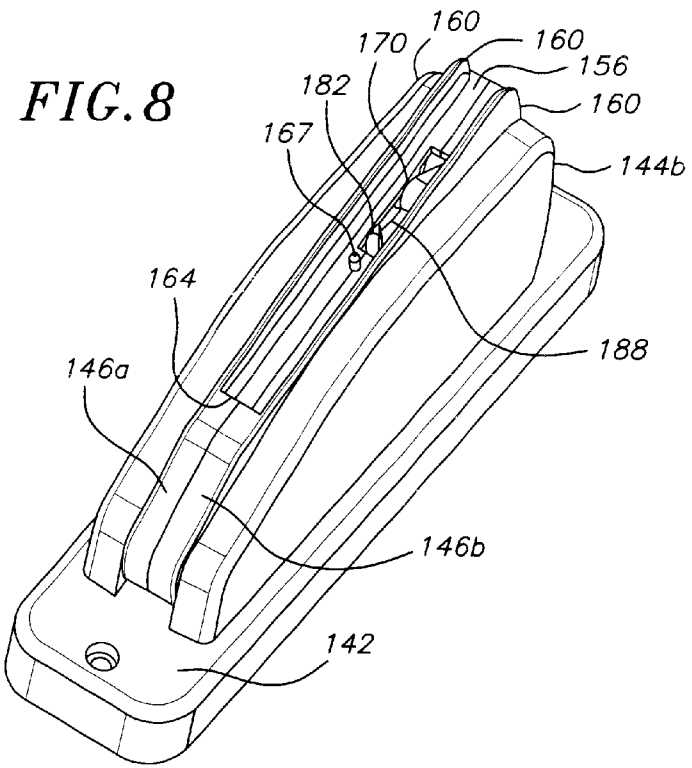
FIG. 8 is a top plan view of the releasor of FIG. 5.
Figure 9:
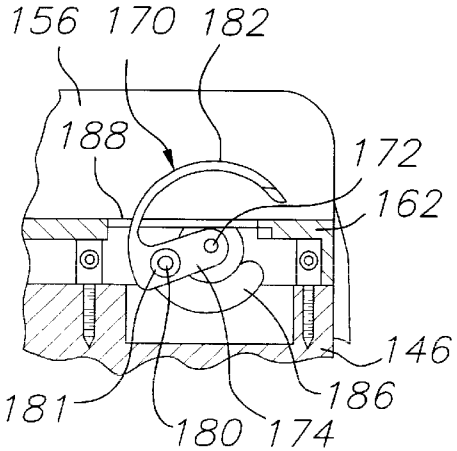
FIG. 9 is a side cross-sectional view of a portion of a releasor, in the lowered position.

Advantageously, the locking tab 18 remains in the closed or locked position until the security keeper 10 is released by a releasor 140. Referring to FIGS. 5–9, the releasor 140 comprises a base 142 from which two parallel support members 144 (namely 144*a* and 144*b*) extend upright therefrom, and an arm 146 that is pivotably supported between the upright members 144 by a pivot 148 and movable between a raised, resting position (FIGS. 5, 7 and 8), and a lowered, releasing position (FIGS. 6 and 9). The arm 146 however is biased toward the raised, resting position by a spring 150, arranged in seats 152 and 154 between the base 142 and the arm 146, and the arm 146 may be moved to the lowered, releasing position under a downward pressure exerted directly or indirectly on the arm 146. The arm 146 is constructed of two opposing pieces 146*a* and 146*b* which are substantially mirror-images of each other. The pieces 146*a* and 146*b* are configured such that when joined a channel 156 is formed in which the security holder 10 (with or without a jewel box or case) can be received. The channel 156 may be defined by two side panels 160, an end panel 164, and a bottom panel 162. To facilitate proper alignment and positioning of the security keeper 10 within the channeled member 156, an alignment pin 167 is provided and extends upwardly from the arm 146 and through the bottom panel 162, to enter aperture 169 of the keeper 10 (best seen in FIG. 4).

Figure 7:
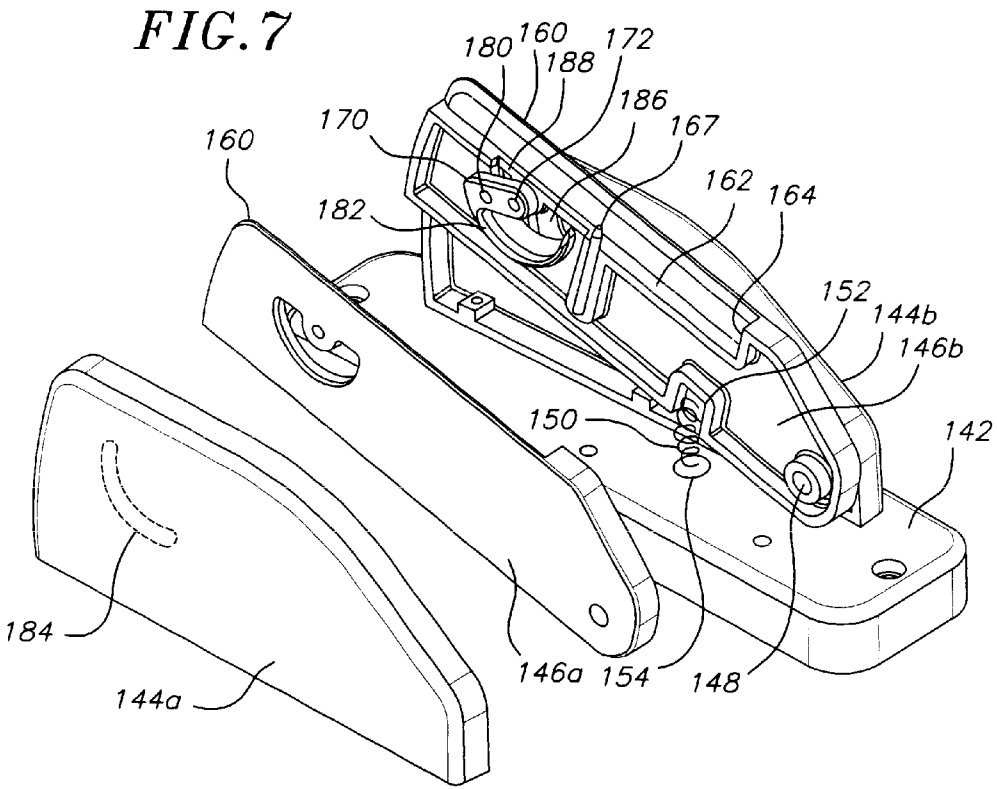
FIG. 7 is an exploded view of the releasor of FIG. 5.
Figure 10:
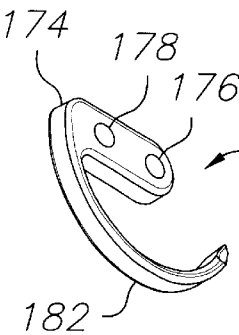
FIG. 10 is a perspective view of a release member.

Referring to FIGS. 7, 9 and 10, the releasor 140 employs an arcuate release member 170 that is articulated relative to the channel 156 by a rivet 172 pivotably securing the release member 170 to the bottom panel 162 of the channel 156. The release member 170 has a radial linking portion 174 with two apertures 176 and 178 (FIG. 10). The aperture 176 receives the rivet 172 which affixes the release member 170 to the arm 146. The aperture 178 receives a transverse pin 180 so that the release member 170 (and especially finger element 182) can move in a predetermined manner. In particular, the transverse pin 180 is contained within plain bearings 181, where the ends of the pin 180 ride in grooves 184 (FIG. 7, in broken lines) provided in each of the interior of the upright support members 144*a* and 144*b*. As the arm 146 is depressed from the raised position to the lowered position, the pin 180 guided by the grooves 184 drives the finger element 182 to move between a retracted position (FIG. 7) and an extended position (FIG. 9). To accommodate movement of the transverse pin 180, openings 186 are provided in each of the arm pieces 146*a* and 146*b*. Moreover, the bottom panel 162 of the channel 156 is configured with an opening 188 so that the finger element 182 can move upwardly into its extended position.

Referring back to FIGS. 1, 3 and 4, the security keeper 10 is provided with an aperture 200 in the bottom extended portion 64, between the space 70 and the locking mechanism 16, for receiving the finger element 182. That is, when the security keeper 10 is properly positioned in the releasor 140 for release, the aperture 200 is aligned so that the finger element 182 can enter through the aperture 200 and arcuately reach inside the space 68 wherein the locking member 20 of the locking mechanism 16 is otherwise enclosed and sealed within the keeper 10.

Figure 11:
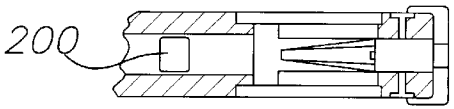
FIG. 11 is a top sectional view of the theft resistant container of FIG. 1 situated in the releasor of FIG. 10.
Figure 12:
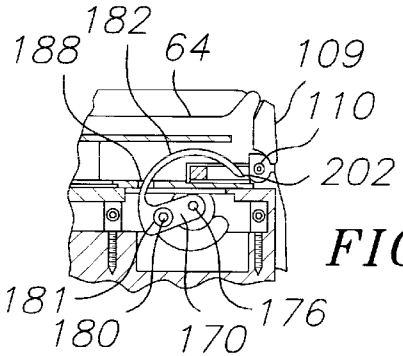
FIG. 12 is side cross-sectional view of a portion of a releasor while releasing a theft-resistant container of FIG. 1.
Figure 13:
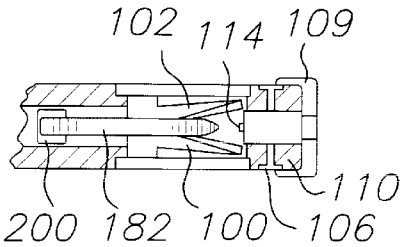
FIG. 13 is a top view of the releasor of FIG. 12.

As shown in FIGS. 11, 12 and 13, as the finger element 182 reaches into the space 68, the finger element comes into contact with the prongs 100 and 102, in particular, the inclined portion 122 thereof. As further downward force is exerted directly or indirectly on the arm 146 of the releasor 140, end 202 of the finger element 182 is forced between the prongs 100 and 102 to separate them. As the prongs separate and move into the recesses 117 and 119 (FIG. 1) of the bottom extended portion 64 and the cover member 14, respectively, the prongs no longer abut the flat region 112 of the body portion 106 of the locking tab 16, which abutment previously prevented the body portion 106 from rotating about the rivet 110 (FIG. 3). As a result, the locking tab 18 is free to rotate in the counterclockwise direction from the locked position to the unlocked position. In that regard, the security keeper 10 advantageously provides the bias member 22 biasing the locking tab 18 toward the unlocked or open position (FIG. 4). That is, once the prongs are separated and no longer abutting the body portion 106, the bias member automatically rotates the locking tab 18 in a counterclockwise direction, springing open the locking tab 18 without any manual intervention or assistance. With the keeper 10 unlocked, the jewel box 24 may be removed (or as the situation may be, may be inserted into an otherwise empty keeper 10).

Referring to FIGS. 1 and 4, the bias member 22 in the disclosed embodiment comprises of a sufficiently elastically bendable leaf spring 203. Best shown in FIG. 4, the locking tab 18 and the locking member 20 are each configured with a channel 204 and 206, respectively, to receive the leaf spring 203 which remains in the channels 204 and 206 throughout operation of the security keeper 10 and the releasor 140. The leaf spring 203 has sufficient memory such that it maintains a counterclockwise rotational force on the locking tab 18 about the pivot 110, but it also has sufficient pliability such that it does not break or fracture when the locking tab 18 is in the locked or closed position for an extended period of time.

Figure 14:
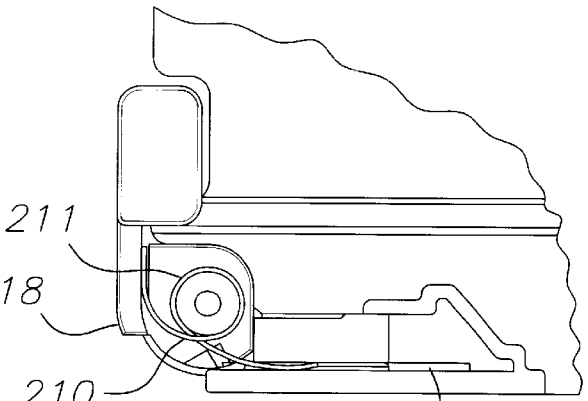
FIG. 14 is a side elevational view of a portion of the theft-resistant container of FIG. 1, in an alternative embodiment.

Whenever the prongs 100 and 102 are separated by the finger element 182 and are no long abutting the flat region 112 of the locking tab 18, the bias member 22 rotates or otherwise moves the locking tab 18 to the open position. It is understood by one of ordinary skill in the art that the bias member 22 may be a coil spring or other comparable structure appropriately positioned within or adjacent the locking tab and/or locking member to bias the locking tab toward the open or unlocked position. As shown in FIG. 14, a coil spring 210 may be used, where it resides within a groove 211 provided in the body portion 106 of the locking tab 18.

Referring again to FIGS. 1 and 2, the security keeper 10 is configured to receive a jewel box 24 containing a CD in a manner such that the opening edge 32 of the jewel box is covered by the side wall 42 of the keeper 10. The jewel box 24 is securely contained within the keeper 10 by means of the locking tab 18 and the tabs 52, 56 and 58. In particular, the top wall 44 and the bottom wall 46 of the keeper prevents significant vertical relative movement between the jewel box 24 and the keeper 10, and the side wall 42 and the securing portion 108 of the locking tab 18 prevents significant lateral relative movement. The tabs 52, 56 and 58, and lip 109 of the L-shaped securing portion 108 prevents the jewel box 24 from being lifted out of or otherwise removed from the keeper 10.

The jewel box 24 is released from the keeper 10 by placing the jewel box in the channeled member 156 of the releasor 140 as it rests in the raised position such that the side wall 42 of the keeper 10 abuts the end panel 164 of the arm 146. With a downward pressure exerted either on the arm 146 or the keeper 10 sitting therein, the arm is depressed from the raised position to the lower, releasing position. With this movement, the finger element 182 of the arcuate release member 170 reaches into the space 68 of the keeper 10 through aperture 200 and separates the prongs 100 and 102. So separated, the prongs 100 and 102 no longer abut the locking tab 18 which now being free to pivot about the pivot 110, rotates under the bias force of the bias member 22 to automatically move from the locked position to the unlocked position. With the L-shaped securing portion 108 of the locking tab no longer abutting the hinged edge 34 of the jewel box 24, the jewel box 24 may be readily removed from the keeper 10. By the same unlocking operation, an otherwise empty keeper 10 may receive a jewel box 24.

To close the locking tab 18, pressure may be exerted on the securing portion 109 in a clockwise direction, whereupon the inclined portions 120 and 122 of the body portion 106 and the prongs 100 and 102 readily permit such clockwise rotation.

Figure 15:
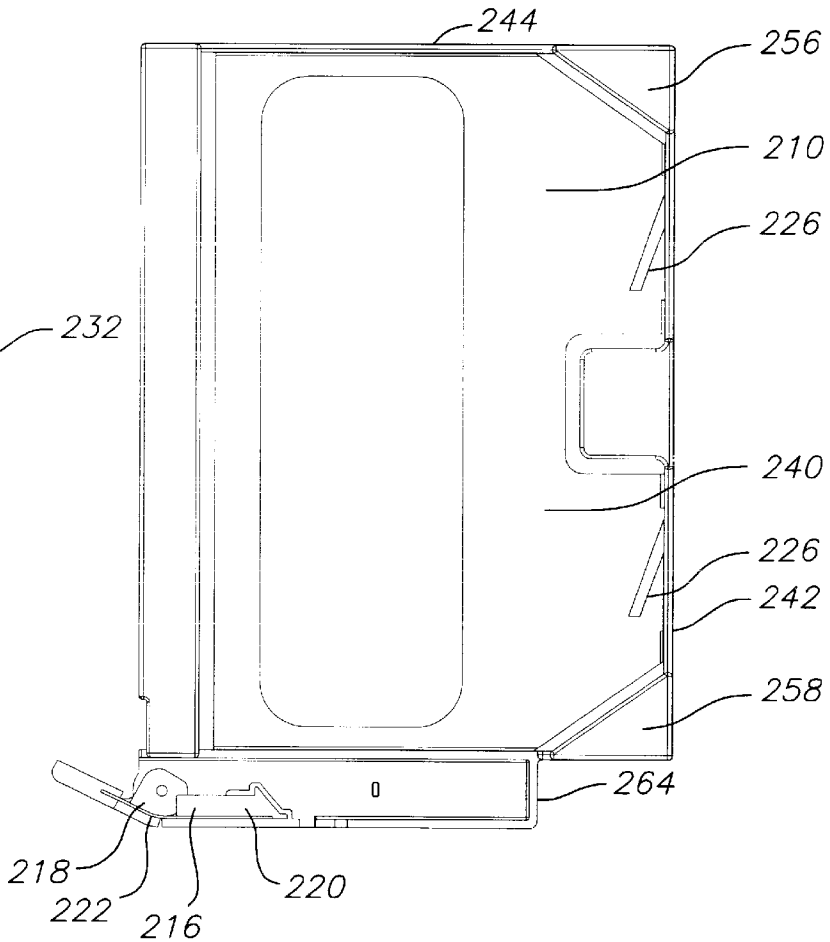
FIG. 15 is a side elevational view of an alternative embodiment of a theft-resistant container of the present invention.
Figure 16:
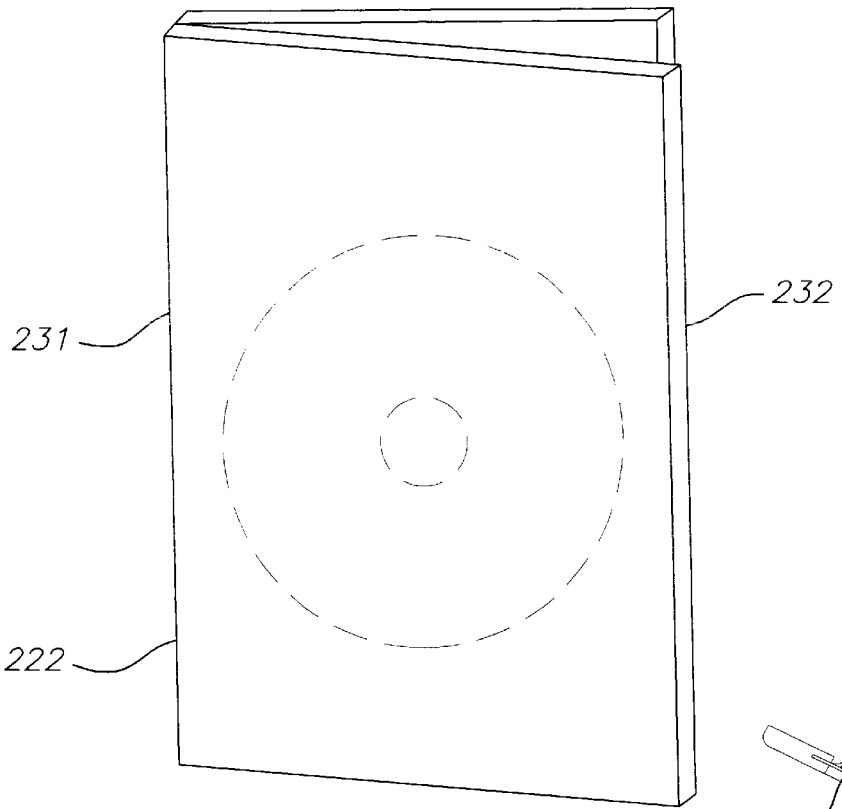
FIG. 16 PRIOR ART
FIG. 16 is a perspective view of a case containing a valuable article, namely, a DVD, of the prior art.

The security keeper of FIGS. 1–4 is best suited for use with the jewel box 24 for CDs. However, a security keeper of the instant invention may also be used for DVD cases. As shown in FIG. 15, a security keeper 220 is configured comparably to the keeper 10, with like components having reference numerals sharing the same last two digits. Accordingly, keeper 220 has a frame 210 (inclusive of a back panel 240 and an aperture 250, a top wall 244, a bottom wall 246, side wall 242, an extended frame portion 264, and corner tabs 256 and 258), a cover member 214 (not shown) and a locking mechanism 216 (inclusive of a locking tab 218, a locking member 220 and a bias member 222). However, instead of the tab 52 as provided in the keeper 10, the keeper 220 provides a front panel 224 extending between the top wall 244 and the bottom wall 246. The DVD keeper 220 also provides spring members 226 for adapting the keeper 220 to DVD cases of different sizes. In the preferred embodiment, the spring members 226 are cutout sections of the side wall 242 that are bent inwardly or otherwise formed to extend into the interior of the keeper 220. As such, the spring members 226 are slightly but suitably elastically pliable and their angle of extension will conform to and be determined by the size of the DVD case contained within the keeper 220. It is noted that the spring members 226 may be located anywhere within the keeper 10, as suitable or desirable.

A DVD case 222 suitable for containment in the keeper 220 is shown in FIG. 15. Similar to the keeper 10, the keeper 220 contains the DVD case in a manner whereby an opening edge 232 of the case 222 (which opposes a "living hinge 231) is covered by the side wall 242. In lieu of the tab 52, the front panel 224 works with the comer tabs 256 and 258 to prevent the case 222 from being lifted out of or separated from the keeper 220. Depending on the manufacturer of the DVD case 222, it may vary in size. However, such size differences are readily accommodated by the spring members 226 of the keeper 220, such that the case 222 remains relatively snugly contained in the keeper 220, as described above.

It may be seen that the system of the present invention may be readily incorporated in various embodiments to provide an improved anti-theft keeper of valuable articles. It is understood by one of ordinary skill in the art that the bias member and the spring members may assume different configurations all accomplishing the same desirable result. It is also understood by one of ordinary skill in the art that the configurations and dimensions of various components may be altered and modified as desirable. In that regard, various alternative techniques and configures may be employed departing from those disclosed and suggested herein.

Consequently, it is to be understood that the scope hereof should be determined in accordance with the claims as set forth below.

What is claimed is:

1. A theft-resistant container for a valuable article, comprising:

a frame configured to contain the valuable article, said frame having a back panel and edges from which at least three walls extend perpendicularly therefrom to contain said valuable article one of said walls configured with a cutout spring member to press against said valuable article contained in said container;

a locking mechanism having a locking tab, a locking member and a leaf spring, the locking tab pivotable between a locking position and an unlocking position, the leaf spring extending between the locking tab and the locking member and configured to move along with the locking tab and bias the locking tab to pivot toward the unlocking position.

2. The container of claim 1, wherein the valuable article has an opening edge and one of said walls covers the opening edge of the valuable article when contained in the container.

3. The container of claim 1, wherein the frame has an extended portion configured with a clip member to receive the locking member.

4. The container of claim 1, further comprising a releasor for unlocking the locking mechanism.

5. A theft-resistant container for a securing a case article holding an electronic data storage disc, the case article having a hinged edge and an opening edge opposing the hinged edge, the container comprising:

a frame with four comers defined by a back panel having one exposed edge, and an opposing edge from which a side wall extends, the exposed edge adapted to align with the hinged edge of the case article and the opposing edge adapted to align with the opening edge of the case article such that the side wall covers at least a portion of said opening edge when said case article is secured in said container;

a locking mechanism having a locking tab, a releasable locking member and a bias member, the locking tab having an annular body portion and an article securing portion, said locking tab pivotable around one of said corners of said frame between a locked position and an unlocked position, said releasable locking member having pronged ends configured to abut said annular body portion and resist pivotal motion of said locking tab when said locking tab is in said locked position, said pronged ends being subject to deformation to enable pivotal motion of said locking tab to pivot into said unlocked position, the bias member biasing the locking tab to pivot into the unlocked position.

6. A theft-resistant container of claim 5, wherein the bias member is configured to move with the locking tab between the locked position and the unlocked position.

7. A theft-resistant container of claim 5, wherein the bias member extends between the locking tab and the releasable locking member.

8. A theft-resistant container of claim 5, wherein the bias member is a leaf spring extending between the locking tab and the releasable locking member.

9. A theft-resistant container of claim 5, wherein the bias member is a coil spring wound about the annular body portion of the locking tab.

10. A theft-resistant container of claim 5, further comprising at least one spring member configured as a cutout from said side wall.

11. A theft-resistant container of claim 5, wherein the article-securing portion of the locking tab while in said locked position abuts the hinged edge of the case article.

12. A theft-resistant container of claim 5, further comprising a releasor configured with a finger element to deform the pronged ends of the releasable locking member.

13. A theft-resistant container of claim 5, further comprising a releasor configured with a finger element to separate the pronged ends of the releasable locking member and to permit the locking tab to pivot under bias from the bias member to the unlocked position.

14. A theft-resistant container for a securing a case article holding an electronic data storage disc, the case article having a hinged edge and an opening edge which can separate, the container comprising:

a frame defined by a back panel having one exposed edge, and an opposing edge from which a side wall extends, the opposing edge adapted to align with the opening edge of the case article such that the side wall covers at least a portion of said opening edge so as to resist separation thereof while said case article is secured in said container; and a locking mechanism having a locking tab, and a releasable locking member with pronged ends deformable to release the locking tab, said locking tab pivotable around a corner of said frame between a locked position and an unlocked position, said locking mechanism also having a bias member extending between the locking tab and the releasable locking member to bias the locking tab to pivot around the corner toward the unlocked position.

15. A theft-resistant container of claim 14, wherein a portion of the bias member is positioned in a channel in the locking tab.

16. A theft-resistant container of claim 14, wherein a portion of the bias member is positioned in a channel in the releasable locking member.

17. A theft-resistant container of claim 14, wherein the bias member is a leaf spring.

18. A theft-resistant container of claim 14, wherein the bias member is a coil spring wound about an annular body portion of the locking tab.

19. A theft-resistant container of claim 14, further comprising at least one spring member configured as a cutout from said side wall.

20. A heft-resistant container of claim 14, wherein the frame has a top wall and a bottom wall and a front panel extending therebetween.

21. A theft-resistant container of claim 14, wherein the frame has at least one rib.

* * * * *